United States Patent [19]

Bonn

[11] 4,341,079

[45] Jul. 27, 1982

[54] CRYOPUMP APPARATUS

[75] Inventor: John W. Bonn, Columbus, Ohio

[73] Assignee: CVI Incorporated, Columbus, Ohio

[21] Appl. No.: 202,219

[22] Filed: Oct. 30, 1980

Related U.S. Application Data

[63] Continuation-in-part of Ser. No. 136,194, Apr. 1, 1980, Pat. No. 4,275,566.

[51] Int. Cl.[3] ..... B01D 8/00

[52] U.S. Cl. ..... 62/55.5; 55/269; 62/100; 62/268; 417/901

[58] Field of Search ..... 62/55.5, 100, 268; 55/269; 417/901

[56] References Cited

U.S. PATENT DOCUMENTS

| | | | |
|---|---|---|---|
| 3,081,068 | 3/1963 | Milleron | 62/55.5 |
| 3,122,896 | 3/1964 | Hickey | 62/55.5 |
| 3,131,396 | 4/1964 | Santeler et al. | 62/55.5 |
| 3,137,551 | 6/1964 | Mark | 62/55.5 |
| 3,144,200 | 8/1964 | Taylor et al. | 62/55.5 |
| 3,175,373 | 3/1965 | Holkeboer et al. | 62/55.5 |
| 3,177,672 | 4/1965 | Seelandt | 62/55.5 |
| 3,256,706 | 6/1966 | Hansen | 62/55.5 |
| 3,480,054 | 12/1969 | Hogan | 62/55.5 |
| 3,489,978 | 1/1970 | Dellaporta et al. | 62/55.5 |
| 3,492,847 | 1/1970 | Wing | 62/55.5 |
| 3,579,997 | 5/1971 | Thibault et al. | 62/55.5 |
| 3,579,998 | 5/1971 | Rapinat | 62/55.5 |
| 3,688,881 | 6/1972 | Thibault et al. | 62/55.5 |
| 3,769,806 | 11/1973 | Boissin et al. | 62/55.5 |
| 4,072,025 | 2/1978 | Thibault | 52/55.5 |
| 4,121,430 | 10/1978 | Bachler et al. | 62/55.5 |
| 4,148,196 | 4/1979 | French | 62/55.5 |
| 4,150,549 | 4/1979 | Lonesworth | 62/55.5 |
| 4,198,829 | 4/1980 | Cable | 62/55.5 |
| 4,207,746 | 6/1980 | McFarlin | 62/55.5 |

OTHER PUBLICATIONS

"Some Component Designs Permitting Ultra High Vacuum with Large Oil Diffusion Pumps", pp. 140–143, *Vacuum Syposium Translations* of A.V.C. Inc., 1958.

"Vacuum Technology", *International Science and Technology,* Jan. 1963.

"Calcution of Cryopumping Speeds by the Monte Carlo Method", *Vacuum,* vol. 21, No. 5, pp. 167–173, May, 1971.

"Measurements of Adsorption Isotherms and Pumping Speed of Helium on Molecular Sieve in the 10–11–10–7 Torr Range at 4.2 Kelvin," *Journal of Vacuum Sci. & Tech.,* vol. 11, No. 1, pp. 331–336, Jan.–Feb. 1974.

"Performance Assessment of Cryopumping", *Vacuum,* vol. 20, No. 11, pp. 477–480, Nov. 1970.

"Introduction to Cryopump Design," *Vacuum,* vol. 26, No. 1, pp. 11–16, Jan. 1976.

*Primary Examiner*—Ronald C. Capossela

*Attorney, Agent, or Firm*—Seidel, Gonda, Goldhammer & Panitch

[57] ABSTRACT

Cryopump apparatus for evacuating very large chambers to ultra high vacuums includes cryogenic panels alternating with radiation shields having a unique Z-configuration which optically blind the panels. The panels and shields are supported by and housed within structure having specific components slidable along one another to thereby permit necessary movement of the components when the apparatus is subjected to cool-down or warm-up. The apparatus is characterized by very high pumping speeds and is capable of cryopumping from both sides thereof.

20 Claims, 16 Drawing Figures

CRYOPUMP APPARATUS

This application is a continuation-in-part of my copending application, Ser. No. 136,194, filed Apr. 1, 1980, now U.S. Pat. No. 4,275,566, June 30, 1981, for "Cryopump Apparatus", assigned to the assignee hereof.

STATEMENT OF THE INVENTION

This invention relates to cryopump apparatus employed to evacuate large chambers to ultra-high vacuums.

BACKGROUND AND SUMMARY OF THE INVENTION

Cryopumping may be defined as the removal of gas from a chamber by solidifying the gas molecules therein onto a cold surface to produce a very high vacuum within the chamber. In large installations, such as space simulation chambers wherein the present apparatus is designed for use, the pumping speeds required are large. These speeds may be achieved by placing the cryopump inside the chamber. The cryopump surfaces are cooled to ultra low temperatures and are shielded in order to reduce heat absorption by these surfaces from their surroundings. Since heat transfer to these surfaces is effected almost totally by radiation, the cryopump surfaces are generally surrounded by suitably configured radiation shields maintained at substantially liquid nitrogen temperatures. Unfortunately however, shielding reduces pumping speed by requiring the molecules of the gas to be evacuated to be pumped along a more circuitous path prior to solidification.

Shielding array configurations of prior art cryopumping devices are many and varied. None however are believed capable of cryopumping equally on both sides while yet providing high pumping speeds for producing ultra high vacuums in a large chamber, such as a space simulation chamber, for example, and additionally providing cooperating structure permitting free and safe movement of various components of the device due to thermal expansion and contraction, thus obviating the need for periodic alignment, adjustment, and repair.

The present invention employs Z-shaped shields optically blinding cryogenic panel members, and includes structure cooperating therewith for passage of cryogenic and refrigerant fluids. The "floating" construction of the present cryopump assembly permits the necessary movement of certain components due to thermal contraction and expansion without reducing the efficiency and pumping speed of the apparatus.

DETAILED DESCRIPTION OF THE INVENTION

Figure 1:
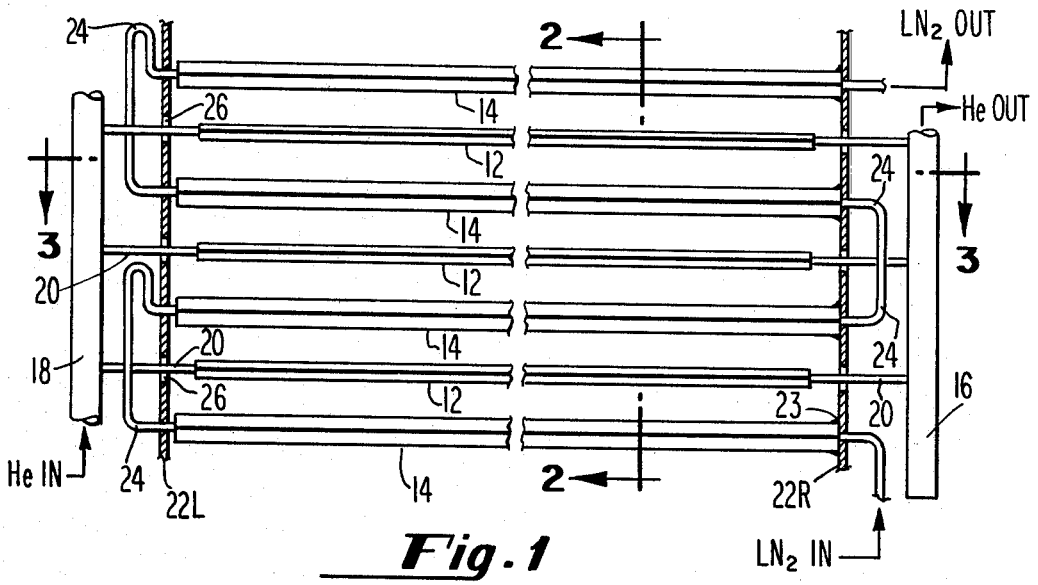
FIG. 1 is a schematic representation of a portion of the cryopump apparatus of the present invention.

In FIG. 1, the present cryopump apparatus includes heat-conductive panels 12 spaced alternately with heat-conductive radiation shields 14. Shields 14 are placed sufficiently proximate one another that panels 12 therebetween are optically enclosed. Conduits 18 and 16 respectively supply and remove cryogenic fluid, preferably liquid helium, to and from the cryopump apparatus. Each panel 12 is connected between conduits 16 and 18 by a connector tube 20 permitting parallel flow of cryogenic fluid through panels 12. Direction of flow of cryogenic fluid is denoted by arrows bearing the legends "He IN" and "He OUT". Shields 14 are secured at their right ends to heat-conductive, metallic (preferably aluminum) right manifold plates 22R, suitably by welds 23 (FIG. 3). Left ends of shields 14 are not welded to left manifold plates 22L. Relative movement therebetween is thermally induced and permitted by structure, later described. Manifold plates 22R thermally contact shields 14. Manifold plates 22L thermally contact shields 14 through jumper tubes 24 to substantially assume the temperature thereof, which temperature is substantially that of refrigerant fluid flowing through bore 38 (FIG. 2) provided within each shield 14. Bores 38 are serially connected by jumper tubes 24. The lowermost shield of FIG. 1 is connected to a supply of refrigerant fluid, preferably liquid nitrogen, indicated "$LN_2$ IN", and passes out the uppermost shield at "$LN_2$ OUT". Consequently, flow of liquid nitrogen refrigerant fluid through shield 14 is serial. Clearance holes 26 for passage of connector tubes 20 therethrough are provided in manifold 22L and 22R to prevent contact therebetween.

In FIG. 5, each panel 12 has heat exchange surfaces 28 and 30 on opposite sides thereof and includes bore 32 for conducting the cryogenic fluid through panel 12 in heat-transfer relationship with heat exchange surfaces 28 and 30. Each panel, preferably aluminum, is highly heat-conductive, and formed as a single extruded member having bore 32 integrally formed therein during the extrusion process. Tubes 20 are preferably welded to panel 12. Each panel 12 is provided with ribs 34 and 36 extending substantially the length of the panel, but from opposite faces thereof, i.e., from surfaces 28 and 30, to resist panel deflection.

Figure 6:
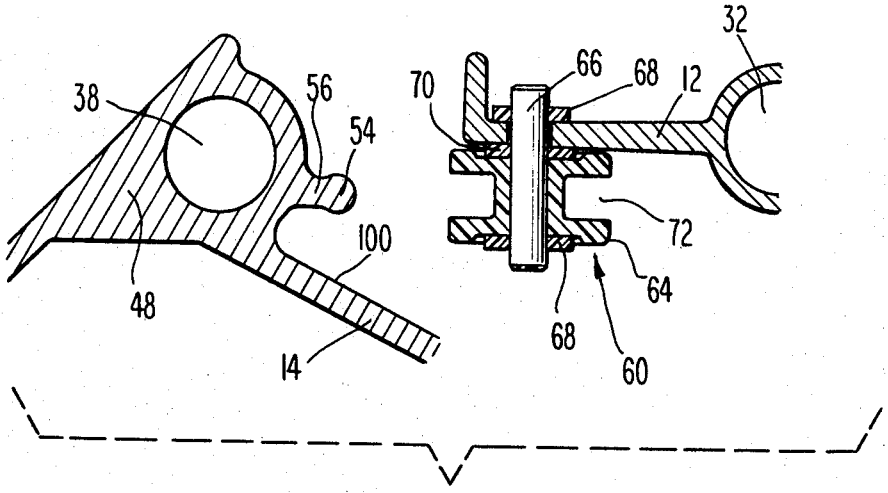
FIGS. 6 and 7 are expanded sectional views of portions of FIG. 2, various components being disengaged for purposes of clarity.
Figure 7:
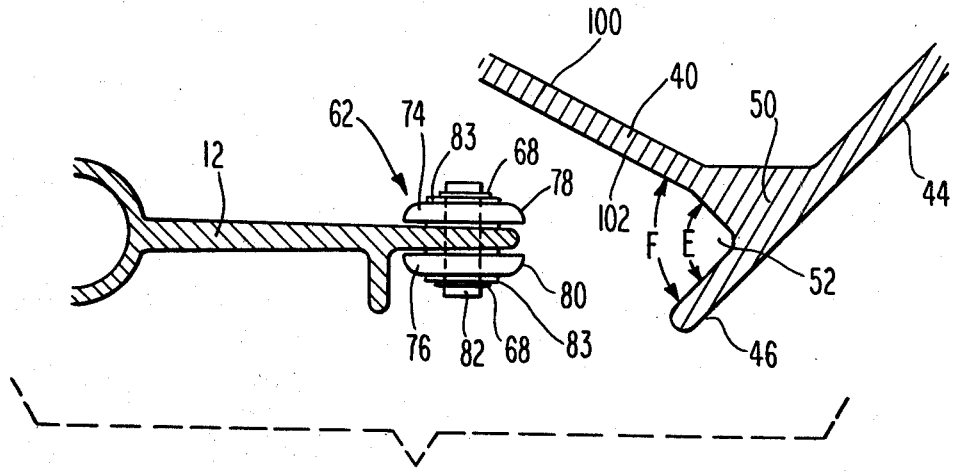

In FIGS. 4, 6, and 7, heat-conductive radiation shields 14 are provided with a "Z"-configuration. Jumper tubes 24, preferably welded to shields 14, protrude from bores 38. Each shield includes a central portion 40 and edge portions 42 and 44 extending therefrom in opposite directions, but parallel with each other to thereby impart the Z-configuration to the shield. Opposite surfaces of central portion 40 of each shield are designated 100 and 102. Shield 14 is preferably extruded, with bore 38 integrally formed therein and includes an integral rib 46 extending the length thereof to resist deflection. Bore 38 is formed at juncture of central portion 40 and edge portion 42 while rib 46 is formed as an extension of portion 44. Such spacing of rib 46 from bore 38 provides added resistance to shield deflection since bore 38, surrounded substantially by metal of enlarged cross section, additionally provides resistance to shield deflection. Each shield has a solid portion of enlarged cross-section at juncture of edge portions 42 and 44 with central portion 40, denoted 48 and 50 respectively. Rib 46, forms, with shield central portion 40, a concavity 52 extending the length of the shield. Lobe 54 is disposed along the entire length of shield 14 exteriorly bore 38 and is connected by a neck 56 to shield 14, as illustrated in FIGS. 2 and 6.

Figure 2:
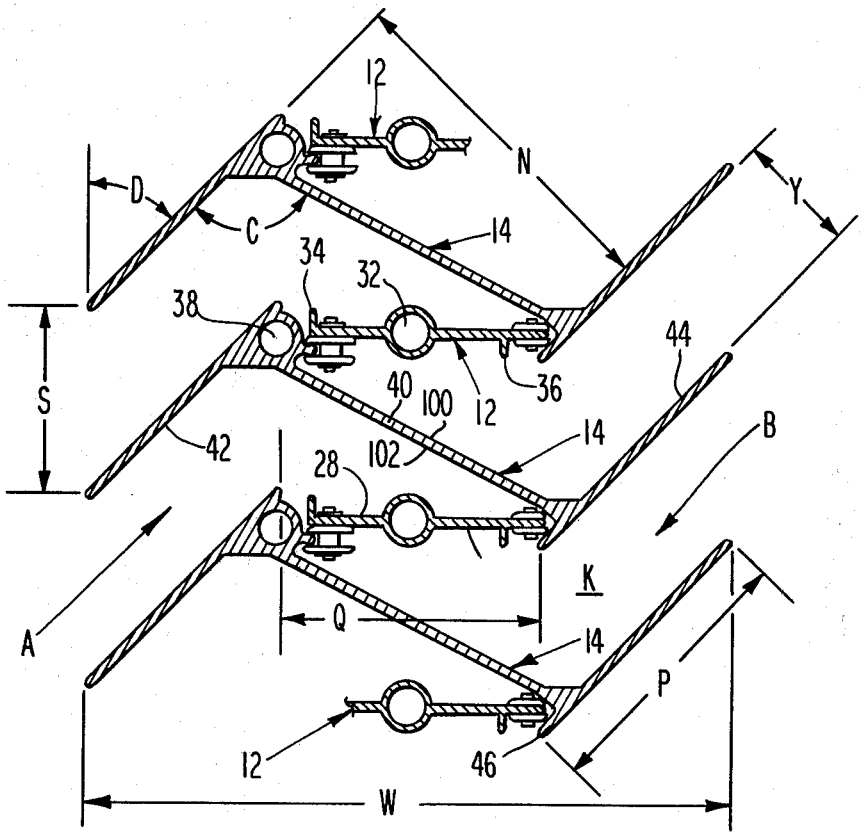
FIGS. 2 and 3 are sectional views of the apparatus of FIG. 1 taken along lines 2—2 and 3—3 thereof respectively.
Figures 3, 4, 5:
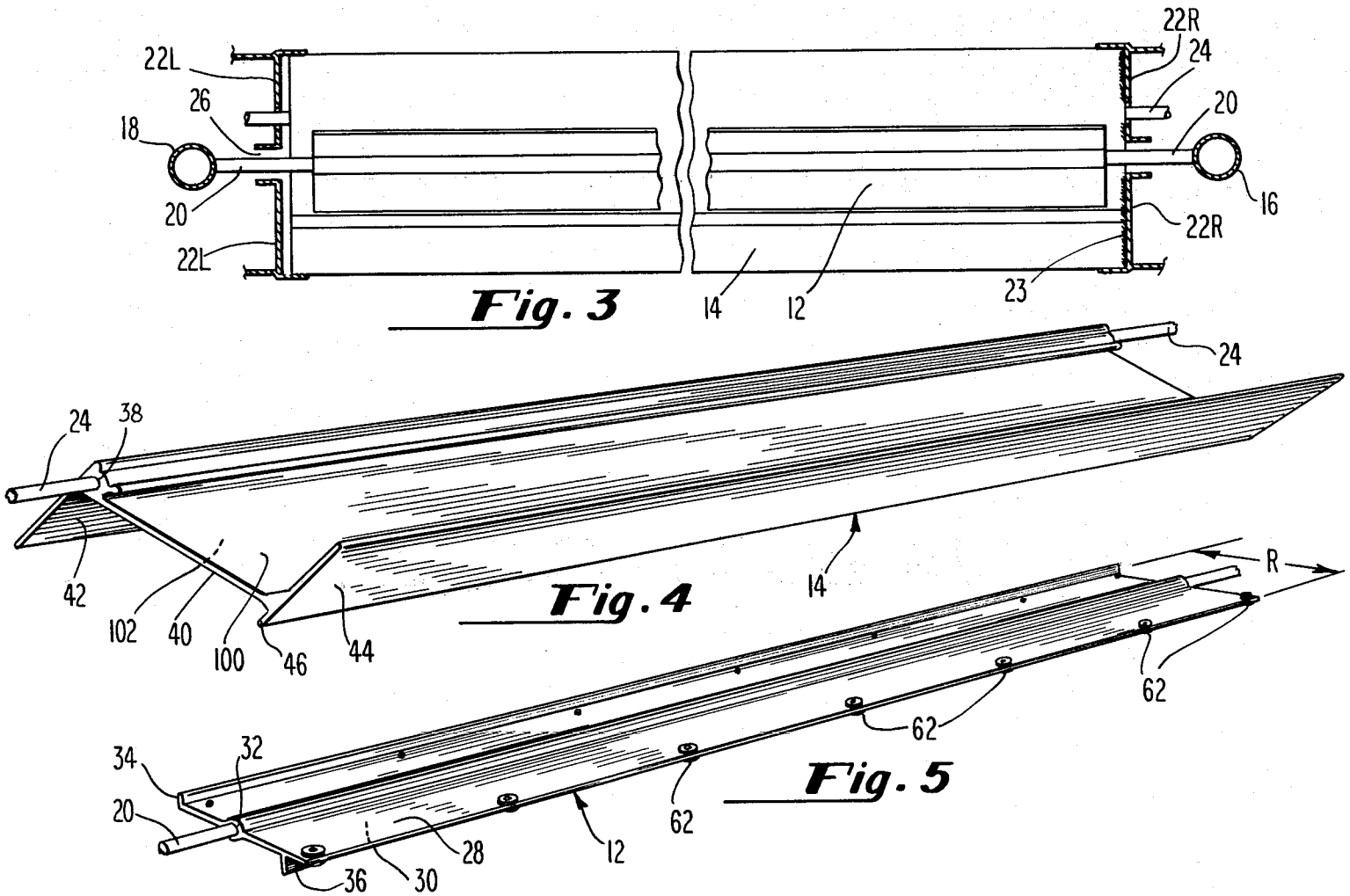
FIGS. 4 and 5 are perspective views of a radiation shield and cryogenic panel respectively of apparatus depicted in FIGS. 1, 2 and 3.

As shown clearly in FIG. 2, surfaces 100 and 102 of adjacent shields 14 define a passageway K of zigzag configuration. Each panel 12 is contained within a passageway K. Bores 38 conduct refrigerant fluid therethrough to provide a heat transfer relationship between the passageway K, defined by surfaces 100 and 102 of shields 14, and the fluid. Panel surfaces 28 and 30 are spaced from surfaces 102 and 100 of passageway K within which each panel 12 is disposed. Each passageway K has openings at ends thereof for flow of gas thereinto, designated by the letters A and B, to respective heat exchange surfaces 28 and 30. Edge portions 42 and 44 of adjacent shields overlap without contacting one another, to optically enclose individual panels 12.

All panels 12 are preferably parallel to each other, as are shields 14. Central portions 40 of shields 14 optically block adjacent panels 12. Shield 14 width is greater than panel 12 width. The shield central portions 40 are preferably angled to the panels.

Spaced along the length of panel 12 are a plurality of engaging means 60 and positioning means 62 which cooperate respectively with lobe 54 and concavity 52 to maintain the spaced relationship between adjacent panels 12 and shields 14 while allowing thermally induced relative longitudinal movement therebetween.

As illustrated in FIG. 6 engaging means 60 includes a heat insulative plug 64 secured to panel 12 by shaft 66 in engagement with push-on speed nuts 68. Shaft 66 passes through a clearance hole in panel 12 and through a central aperture in plug 64. A washer 70 is provided between plug 64 and panel 12. Plug 64 and shaft 66 are preferably a phenolic resin-based material, having high heat insulative characteristics. Plug 64 is provided with an annulus 72 to slidably receive lobe 54 of an adjacent panel 14 (FIG. 2). Positioning means 62 includes upper and lower discs 74 and 76 respectively, each having a convex surface 78 and 80 respectively facing outwardly (FIG. 7). Discs 74 and 76 are preferably of the same heat insulative material as plug 64 and are secured on opposite surfaces of panel 12 by means of speed nuts 68 engaging shaft 82, of similar heat insulative material, extending through panel 12.

Washers 83 separate speed nuts 68 from discs 74 and 76. Concave surfaces 78 and 80 of discs 74 and 76 are slidably received within concavity 52 of an adjacent shield, clearly shown in FIG. 2. Shields are retained in relative position by welds 23 to manifold plates 22R. However, the sliding engagement of lobe 54 within annulus 72, and the sliding receipt of discs 74 and 76 within concavity 42, permit thermally induced relative longitudinal movement between a panel 12 and its enclosing shields 14. Such movement is necessary since panels 12, preferably cooled by liquid helium, are cooled to a substantially lower temperature than are shields 14, preferably cooled by liquid nitrogen. Consequently, when the cryopump apparatus is started and the liquid helium and liquid nitrogen are introduced to the panels and shields respectively to cool the apparatus to its operating temperature, the panels will contract substantially more than the shields, resulting in relative motion therebetween.

It is appreciated that the curved exterior surface of lobe 54 contacts substantially flat surfaces defining the interior of annulus 72, and similarly, that curved convex surfaces 78 and 80 contact flat surfaces defining concavity 52. This curved surface-flat surface engagement results in line contact only between the surfaces of interest, assuring minimal heat transfer between adjacent panels and shields.

During operation of the cryopump apparatus, more later, liquid nitrogen and liquid helium are pumped into respective conduits in the directions indicated in FIG. 1. When the panels and shields are cooled to the respective cryogenic and refrigerant fluid temperatures, gas molecules of the gas to be evacuated from the chamber encounter panels 12 to adhere thereto. More specifically, gas molecules entering between adjacent shields, in the directions indicated by arrows A and B in FIG. 2, will, upon encountering the respective surfaces 28 and 30 of panel 12, adhere to the surfaces 28 or 30, providing the pumping effect. The shields and manifold plates optically enclose the panels within an environment maintained substantially at the temperature of liquid nitrogen, thereby reducing radiant heat transfer to the panel from warmer objects exterior of the cryopump apparatus, thereby minimizing the amount of refrigeration required to maintain liquid helium flowing through the panels.

The cryopump shields and panels are preferably fabricated of aluminum. Aluminum is especially suitable because of its good thermal conductivity, relative ductility at low temperatures and ease of forming by extrusion into the shapes required.

The cryopump apparatus may be mounted in a vacuum chamber by securing manifold plates 22R and 22L within the chamber interior in any suitable heat-insulative manner.

No bellows are utilized by the present cryopump apparatus. The floating construction of panels 12 with respect to radiation shields 14 and the manifold plates allows for thermal expansion and contraction and provides good reliability. Orienting the cryopump apparatus as illustrated in FIG. 1, with manifold plates 22R and 22L vertically disposed and with the panels and shields in a vertically stacked configuration, facilitates thermally induced relative movement between the panels and shields while maintaining relative rigid construction.

Pumping speed of the apparatus exceeds 0.28, the amount in excess thereof being controlled by the relationship between the size of the cavity opening, defined by dimension S in FIG. 2, and the cavity depth, defined by panel width A in FIG. 5. As Q/S increases, pumping speed increases. The following table gives pumping speed of the invention for various values of Q/S and angle D, approximately 45° (FIG. 2).

TABLE 1

PUMPING SPEEDS

| D | Q/S | Pumping Speed |
|---|---|---|
| 45° | 1 | 0.287 |
| 45° | 2 | 0.335 |
| 60° | 2 | 0.379 |

Pumping speed represents the fraction of gas molecules captured by the pump, and is calculable by the Monte Carlo method as described in *Calculation of Cryopumping Speeds by the Monte Carlo Method,* Vacuum, vol. 21, No. 5, May 1971, pp. 167–173; and *Introduction to Cryopumping Design,* Vacuum, vol. 26, No. 1, January 1976, pp. 11–16, both Pergamon Press Ltd.

The apparatus may be constructed with panels 12 and shields 14 ranging in length up to about twenty-nine feet between manifold plates as shown in FIG. 1.

Angle C of shield 14 (FIG. 2) is preferably about 109°. Angles E and F (FIG. 7) are preferably about 90° and 71° respectively. Shields 14 may be fabricated having a width W (FIG. 2) of about 14 inches and mounted on the manifold plates such that about four inches exist between corresponding parts of adjacent shields. A panel enclosed by such a shield is preferably about 5⅛ inches wide, denoted by the letter R in FIG. 5. The panels and shields are about one quarter inch thick.

Engaging and positioning means 60 and 62 may be spaced about to about seven feet when the panels and shields are made in the twenty-nine foot lengths. Means 60 and 62 should not be spaced much in excess of about seven feet or deflection of the panels might result in panel-shield contact which would effectively "short circuit" the shield, causing it to drop to the temperature of the panel during pump operation with a consequent dramatic increase in required cryogenic refrigeration.

The shield central portions 40, designated N in FIG. 2 may have lengths of about seven and one half inches, with the edge portions 42 and 44, indicated P, having lengths of about five and one half inches, resulting in a vertical spacing between adjacent shields of about two and one half inches as indicated by the letter Y.

Angles between shield edges and central portions are not critical so long as the shields retain their Z-configuration to optically blind the panels enclosed thereby from exterior view. However, as shields are spaced further apart, in order to maintain optical blinding of an enclosed panel from external view, angle C must decrease. As angle C decreases, pumping speed will also decrease. However, as panel width increases, pumping speed increases. An advantage of the cryopump configuration disclosed is the high ratio of panel width R to distance between adjacent shields S, resulting in high pumping speed.

Region K of FIG. 2 may be considered as a cavity in which panel 12 forms a portion of the cavity wall and the remainder of the cavity wall is formed by a central portion of a shield 14. The entrance to the cavity may be considered to be along a line connecting the corresponding junctures of the central and edge portions of adjacent shields. The edge portion of the shield whose central portion forms the remainder of the cavity wall extends from the cavity opening to blind the panel within the cavity from direct incidence of radiation originating outside the cavity. The edge portion of the shield is positioned so that any straight line drawn from the panel within the cavity through the cavity opening intersects the shield edge portion, thus defining optical blinding of the panel by the shield edge portion. An advantage of the disclosed cryopump is the formation of these cavities in pairs, in a nested arrangement, with each panel contributing a pumping surface forming part of the interior of two pumping cavities. Substantially the entire surface of each panel is exposed for pumping.

The relationship between the size of the cavity opening, defined by dimension S in FIG. 2, and the cavity depth, defined by panel width R in FIG. 5, establishes the theoretical maximum pumping speed of the invention.

Figures 8, 9:
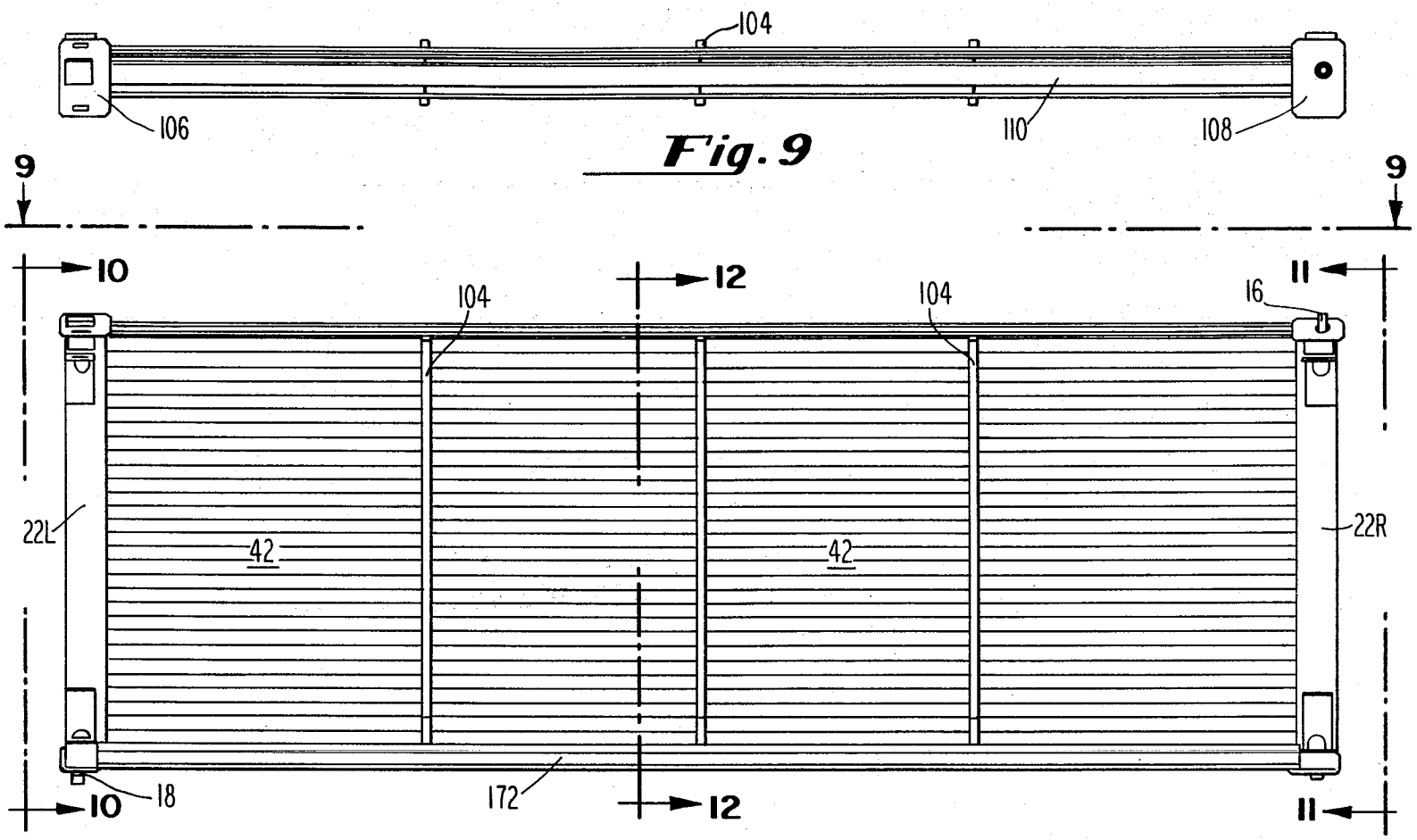
FIG. 8 is a front elevational view of the assembled cryopump apparatus of the present invention.
FIG. 9 is a plan view of the apparatus of FIG. 8.

The assembled cryopump apparatus is illustrated in FIG. 8. FIG. 8 conveniently indicates where views of succeeding drawing figures are taken and, along with FIG. 9, presents the assembled structure in clearer perspective.

Manifold plates 22R and 22L, cryogenic fluid conduits 16 and 18, and edge portions 42 of shields 14 are illustrated in FIG. 8. Shield support brackets 104 for supporting the shields are spaced between the manifold plates. An upper cover plate 106, and an upper cover plate 108, later described, are welded across the top portions of manifolds 22L and 22R respectively. An upper shield plate or guard 110 is suitably positioned above the uppermost shield.

Figure 10:
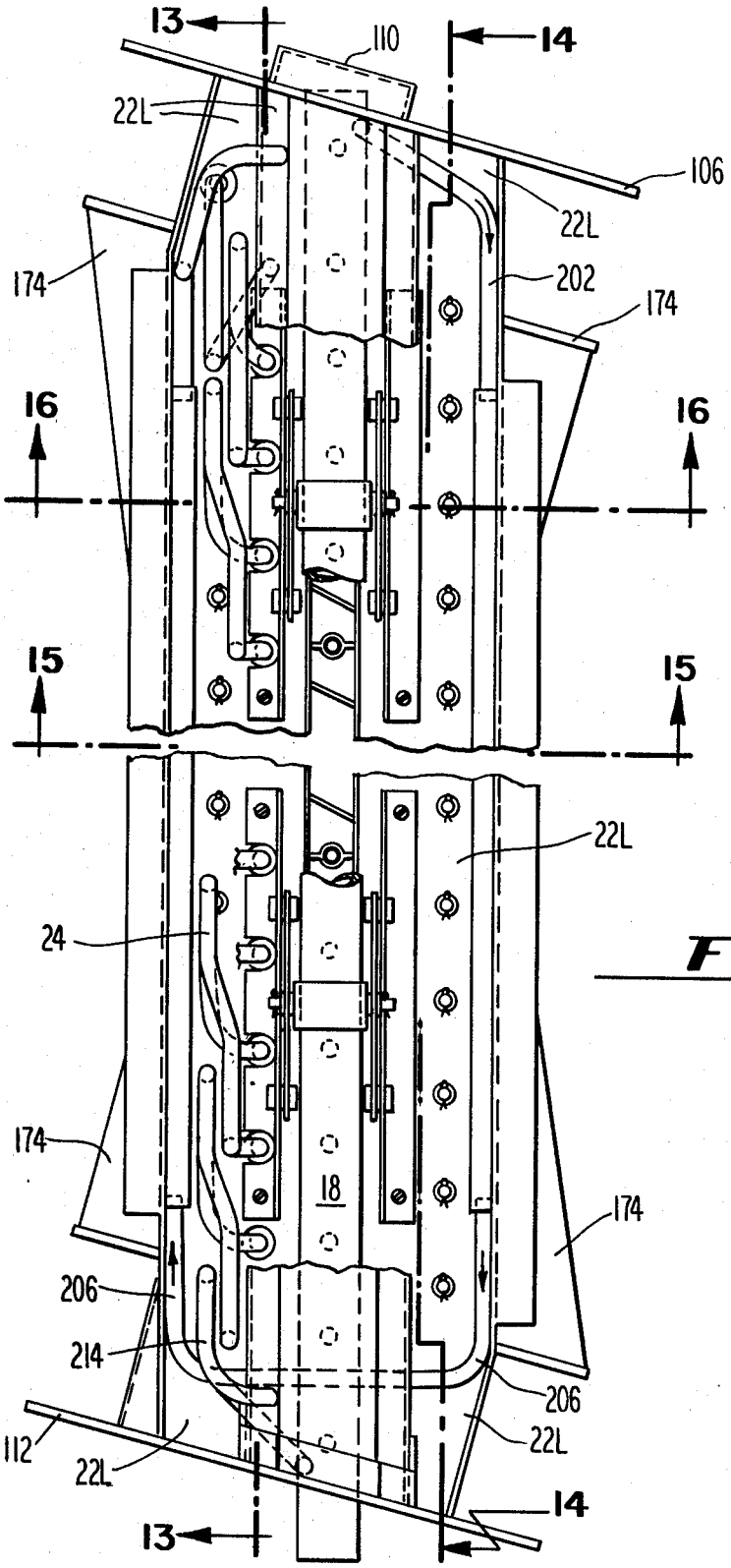
FIGS. 10 and 11 are end views of the apparatus of FIG. 8 looking in the directions indicated by arrows 10—10 and 11—11 respectively.
Figure 11:
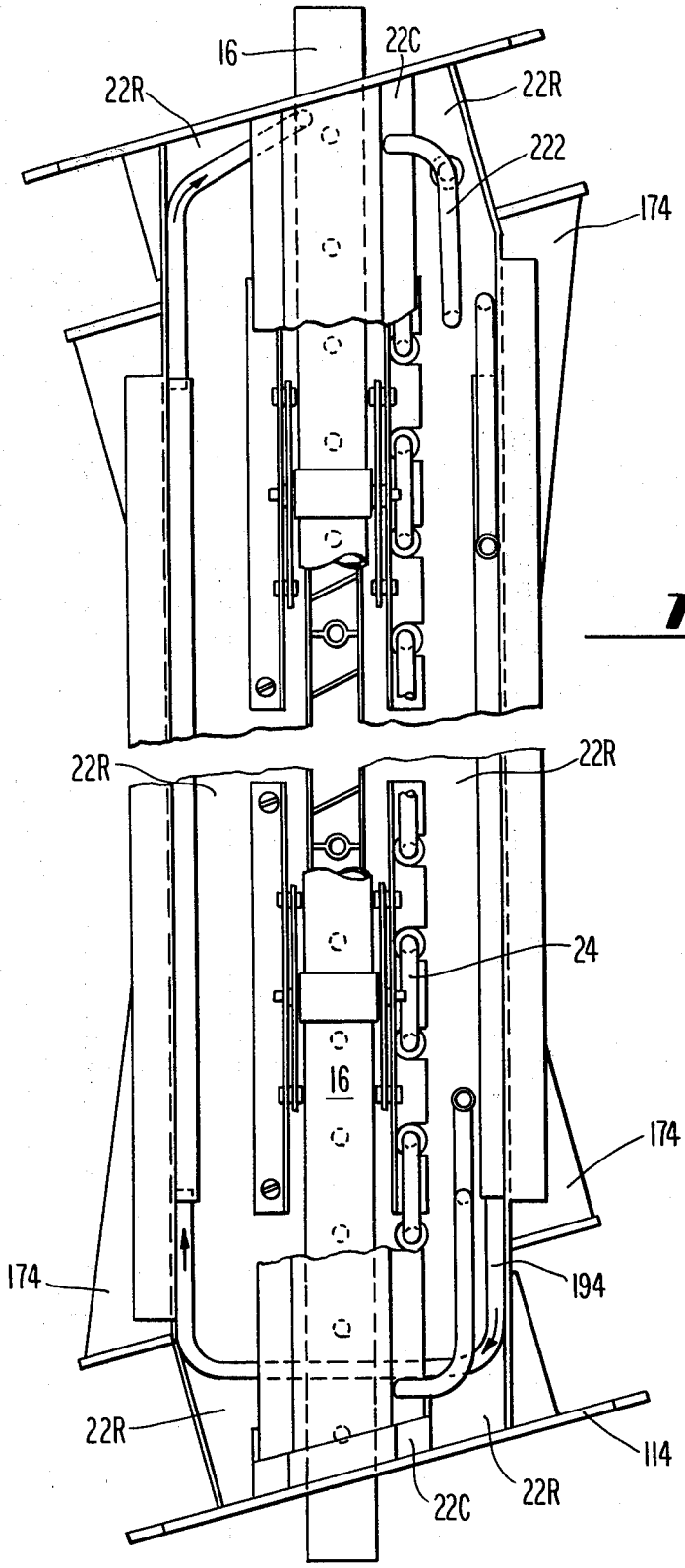
Figure 14:
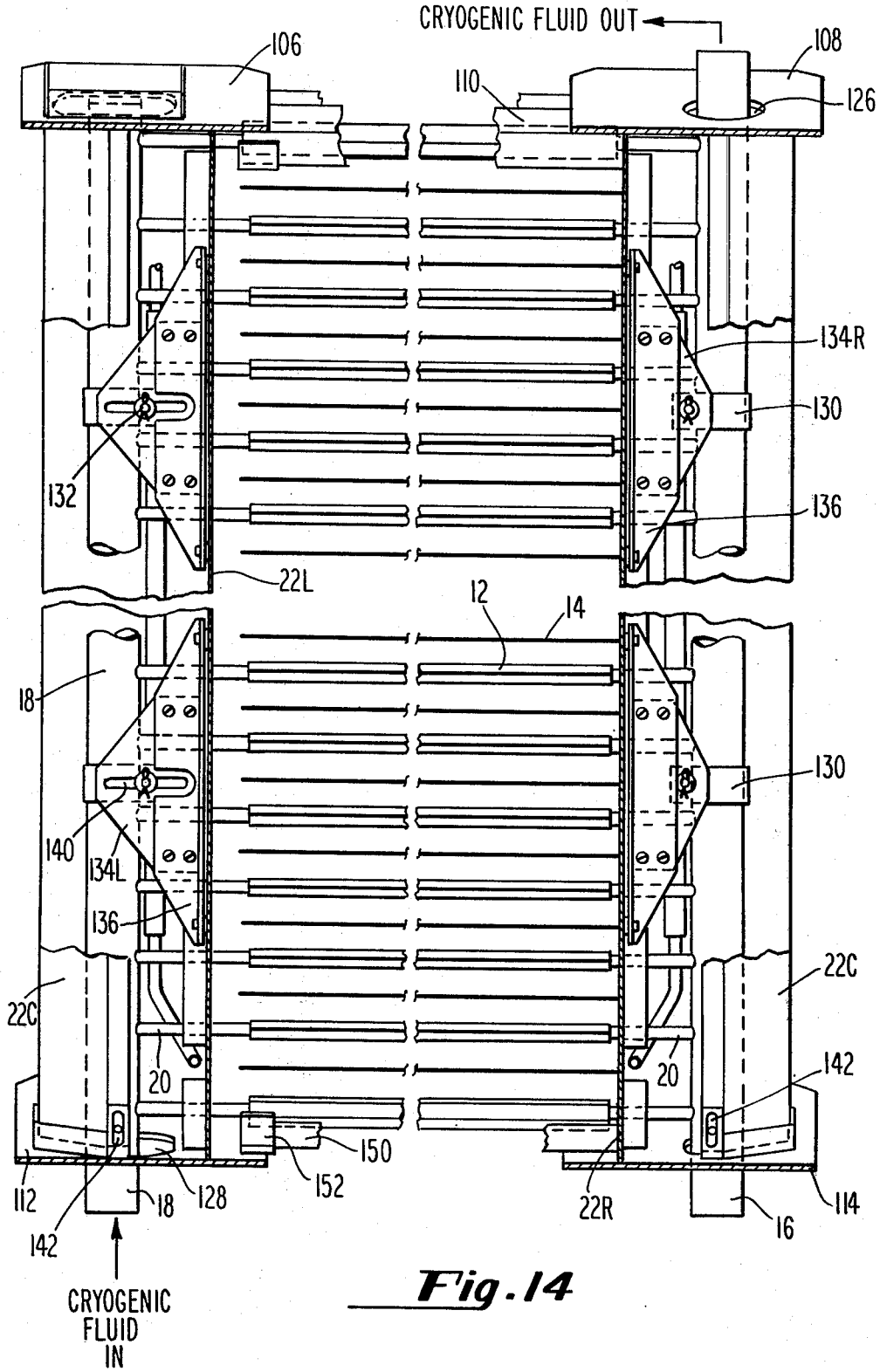
Figure 15:
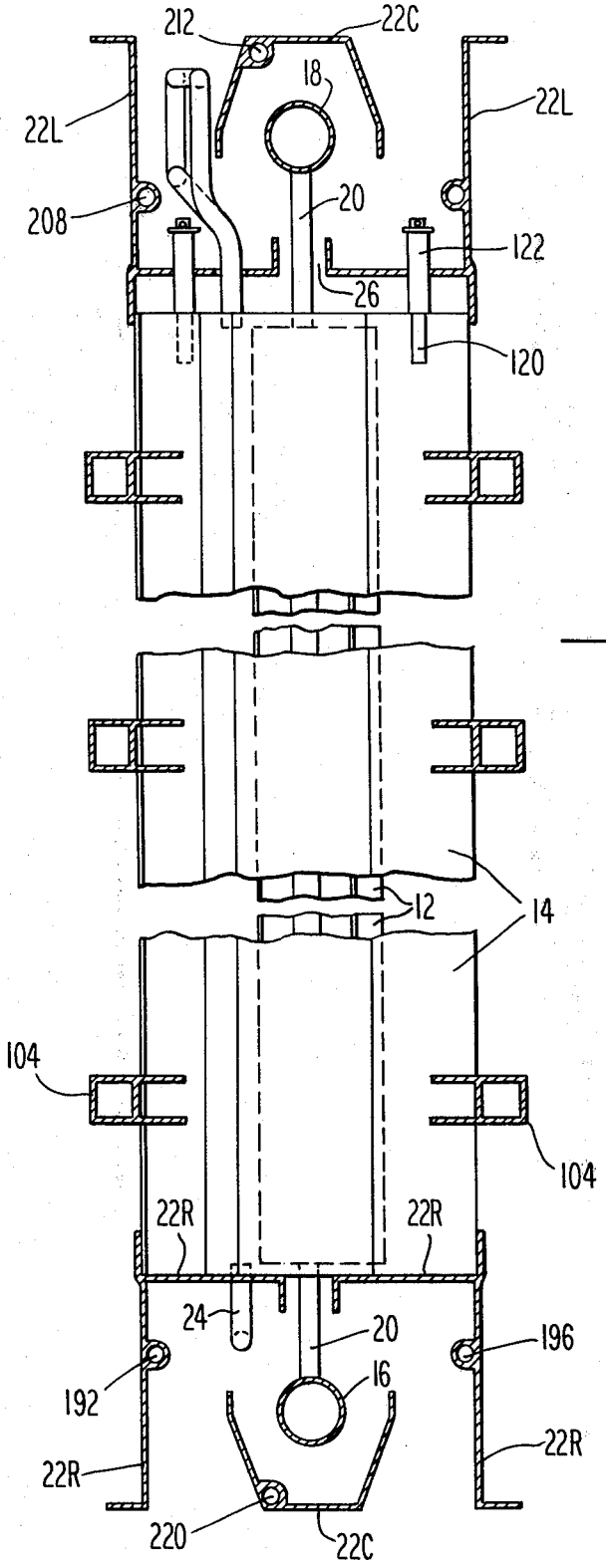
Figure 16:
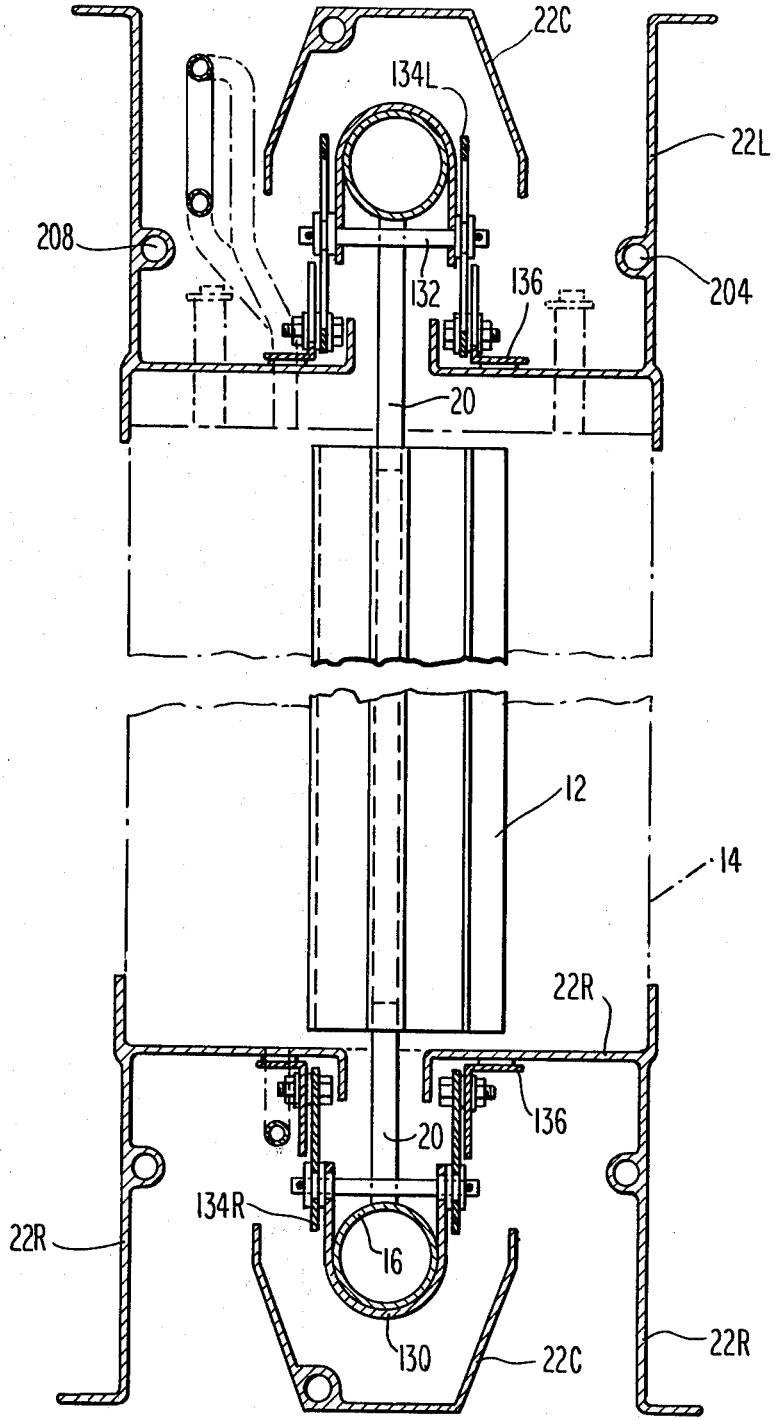

From FIGS. 15, 16, and 3, it is apparent the present cryopump apparatus is supported at its four corners by a pair of vertically disposed manifold plates 22R and 22L, i.e., at its right and left ends respectively. Upper cover plates 106 and 108; and lower cover plates 112 and 114, are welded to manifold plates 22L and 22R respectively (FIGS. 10, 11, 13 and 14). A central manifold 22C (FIGS. 15 and 16) is welded to each of the upper cover plates (FIG. 11).

In FIG. 14, shields 14 are depicted as a series of parallel lines. Shields 14 are welded at their right edges to manifolds 22R (FIGS. 1 and 3). The ends of shields 14 adjacent manifolds 22L are provided with rods 120 (FIG. 15), preferably aluminum, suitably secured thereto, which rods are fitted with stainless steel sleeves 122 which pass through clearance holes 26 (FIGS. 1 and 3) disposed vertically in manifolds 22L to thereby provide support to shields 14 at their left edges while substantially restraining them from movement in any direction except a longitudinal movement with respect to manifolds 22L.

Contact between the dissimilar metals of sleeves 122 with manifolds 22L prevents excessive gulling. Sleeves 122 are retained on rods 120 by conventional washers and cotter pins.

Referring again to FIG. 14, liquid helium conduit 16 passes through a clearance hole 126 in upper cover plate 108. Conduit 16 is closed at its other end adjacent lower cover plate 114. Conversely, conduit 18 passes through a clearance hole 128 in lower cover plate 112 and is closed at its upper end.

Clearance holes 126 and 128 are sufficiently large to prevent contact with the conduits passing therethrough, thus avoiding undesirable heat transfer therebetween.

Conduit 16 is disposed in fixed relationship to manifolds 22R by means of heat-insulative structure including U-shaped brackets 130, (FIG. 16) preferably welded to conduit 16. Rods 132 pass through the two legs of the bracket and through thin fiber webs 134R provided exteriorly the bracket legs. Each of webs 134R communicates with a different one of the two manifold plates 22R through aluminum angle members 136, clearly shown in FIG. 16. Each fiber web 134R preferably comprises a thin, rigid, heat-insulative material, and thermally insulates conduit 16 from a manifold 22R.

Structure interconnecting conduit 18 and manifolds 22L is substantially identical with the structure described. Fiber webs 134L (FIGS. 14 and 16) however are provided with longitudinal slots 140, i.e., slots disposed substantially parallel with the shields and panels.

Slots 140 permit rods 132 to slide therealong. Thus, conduit 18 is movable with respect to manifolds 22L.

Referring to FIGS. 15 and 16, central manifolds 22C optically block conduits 16 and 18 from view exteriorly the cryopump apparatus. As aforementioned, one of the central manifolds 22C is welded to upper cover plate 106 and the other to cover plate 108. Central manifolds 22C are respectively bolted to lower cover plates 112 and 114 by a plurality of boltslot arrangements 142 permitting relative movement of the central manifolds with respect to the lower cover plates.

As shown in FIGS. 1, 14 and 15, panels 12 are structurally and fluidically connected between conduits 16 and 18 by means of connector tubes 20. Cryogenic fluid passing through bores 32 of panels 12 traces a parallel flow pattern. Connector tubes 20 pass through clearance holes 26 in the respective manifolds without contact therewith.

Figure 12:
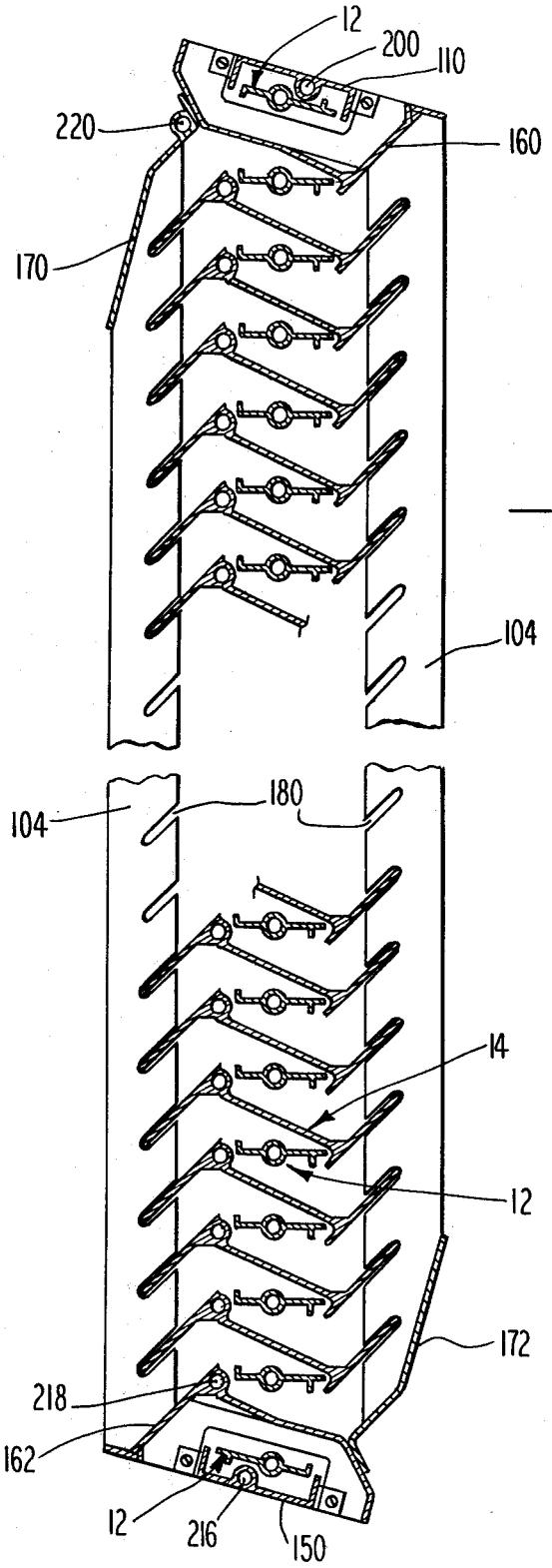
FIG. 12 is a sectional view of FIG. 8 taken along line 12—12 thereof.

The cryopump apparatus is provided with an assortment of plates or guards for shields 14. Thus, upper shield plate or guard 110 (FIGS. 2, 10, 11, 12 and 14) is welded to cover plate 108. A lower shield guard 150 is welded to lower cover plates 114. Brackets 152 are welded to upper cover plate 106 and lower cover plate 112. The unwelded ends of shield guards 110 and 150 are thus slidable on brackets 152. Shield guards 110 and 150 each partially enclose a panel 12 therewithin (FIG. 12).

Upper and lower inner shield guards 160 and 162 respectively, and upper and lower lateral shield guards 170 and 172 respectively (FIG. 12), each have an end thereof welded to one of the manifold plates 22R and their other ends in slidable relationship to a corresponding manifold plate 22L by virtue of sliding contact with suitably supported bracket members (not shown).

Gusset plates 174 are welded to the exteriors of the manifold plates (FIGS. 3 and 4) to provide mounting structure for the cryopump apparatus.

Shield support brackets 104 (FIGS. 1, 2, 12 and 15), preferably aluminum channels, are welded at their extremities to respective shield guards, and assist in resisting deflection of shields 14 as well as maintaining proper spacing between adjacent shields. Slots 180 in shield support brackets 104 receive edge portions 42 and 44 of shields 14.

Figure 13:
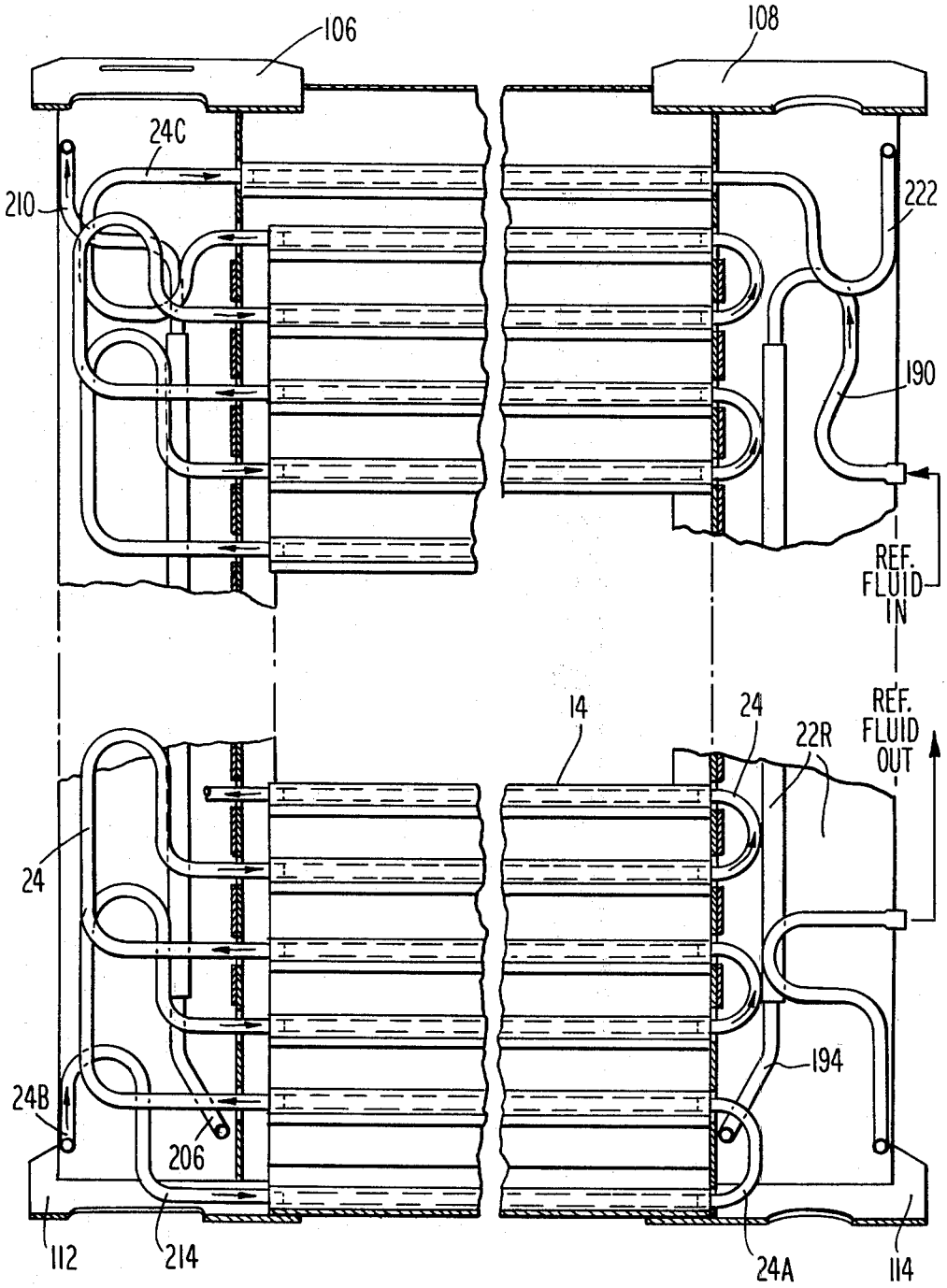
FIGS. 13, 14, 15 and 16 are broken sectional views of FIG. 10 taken respectively along lines 13—13, 14—14, 15—15, and 16—16 thereof.

Referring now to FIG. 11, and more particularly to FIG. 13, shields 14 are interconnected by jumper tubes 24 welded thereto and to a manifold 22R where tubes 24 pass therethrough. Tubes 24 lead into bores 38 in shields 14 for passage of refrigerant fluid therethrough. The jumper tubes at the other ends of shields 14, i.e., the left side as FIG. 13 is viewed, are configured as shown, in order to permit relative movement between adjacent shields during cool-down and warm-up without rupture thereof. As illustrated in FIG. 10, jumper tubes 24 are also curved vertically to further increase the lengths thereof for additional resistance to rupture and to avoid interference with each other. Flow through jumper tubes 24, bores 38, and shields 14 is serial and may be traced by referring to FIGS. 10, 11, 12, 13 and 15.

More specifically, refrigerant fluid enters the cryopump apparatus via connection to tube 190 (FIG. 13), then downwardly through vertical conduit 192 (FIG. 15) formed within manifold 22R to tube 194 (FIGS. 11 and 13), to conduit 196 (FIG. 15) in manifold 22R opposite conduit 192, then upwardly through conduit 196 to tube 198 (FIG. 11) to conduit 200 (FIG. 12) in shield guard 110. The refrigerant fluid then flows laterally through conduit 200 from right to left (FIG. 13 if conduit 200 were shown therein), exits conduit 200 to pass into tube 202 (FIG. 10), thence downwardly into conduit 204 provided in manifold 22L (FIG. 15), exiting therefrom into tube 206 (FIG. 10), then upwardly in conduit 208 in manifold 22L (FIG. 15), to exit tube 210 (FIG. 10) which leads to conduit 212 (FIG. 15) in central manifold 22C, flows downwardly therein into tube 214, then upwardly around, and downwardly to enter conduit 216 formed in lower shield guard 150 (FIG. 12).

The fluid then flows through conduit 216 (FIG. 12), through modified jumper tube 24A (FIG. 13), into conduit 218 in lower inner shield guard 162 (FIG. 12), and through conduit 218 into jumper tube 24B (FIG. 13) leading to the lowermost Z-shaped shield 14. The fluid next proceeds to flow serially through shields 14 by means of bores 30 therethrough, alternating direction through each shield (FIG. 13), finally exiting the uppermost shield to enter a modified connector tube 24C, leading to conduit 220 (FIG. 12) disposed in upper lateral shield guard 170, thence through conduit 220 into tube 222 (FIG. 13) to proceed downwardly through conduit 220 into tube 224 (FIG. 13) to exit the cryopump apparatus.

Thus, flow of refrigerant fluid through the apparatus is basically serial. As aforediscussed, cryogenic fluid flows in a parallel pattern through the panels. As a result, when the cryopump apparatus is cooled to operating temperatures, the panels contract substantially simultaneously and uniformly whereas the shield guards and manifold plates do not. However, the present apparatus is designed to permit sliding between components and members where relative movement therebetween is induced by thermal differences. Indeed, absent provisions for the sliding of specific structural members when the pump is being cooled, the lower portions of the apparatus would start to contract prior to the upper portions resulting in possible fracturing of components and structural members.

I claim:

1. Cryopump apparatus comprising:

(a) means for supplying cryogenic fluid;

(b) means for supplying refrigerant fluid;

(c) panel means within said apparatus including (i) heat exchange surfaces on opposite sides of said panel means, and (ii) bore means for conducting said cryogenic fluid therethrough in heat transfer relationship with said heat exchange surfaces;

(d) means delivering said cryogenic fluid to said panel bore means;

(e) radiation shield means within said apparatus including (i) heat exchange surfaces on opposite sides of said shield means, and (ii) bore means for conducting said cryogenic fluid therethrough in heat transfer relationship with said heat exchange surfaces;

(f) means delivering said refrigerant fluid to said shield bore means;

(g) a zig-zag passageway provided between adjacent shield means, each of said passageways including one of said means optically blocking said panel means.

2. Apparatus of claim 1 wherein said panel means comprises a plurality of spaced panels and said shield means comprises a plurality of spaced shields.

3. Apparatus of claim 2 further characterized by said zig-zag passageway formed by adjacent shields, each of said shields having a Z-configuration.

4. Apparatus of claim 3 wherein said shield Z-configuration is formed by a central portion, an edge portion extending away from each end of said central portion at an angle thereto, said edge portions being parallel to each other.

5. Apparatus of claim 4 wherein said panel enclosed by said adjacent shields is disposed in sliding relationship thereto.

6. Apparatus of claim 5 wherein said sliding relationship is characterized by heat insulating means disposed at each end of said panel, each of said heat insulating means contacting a different shield of adjacent shields.

7. Apparatus of claim 6 wherein each of said shields comprises a male member extending into said passageway, said male member being formed at juncture of one of said edge portions of one of said shields with its central portion, a concavity formed in said passageway formed at juncture of central portion of adjacent shield with other of said edge portions, said heat insulating means at ends of said panel within said passageway engaging said male member and concavity to provide said sliding relationship therebetween.

8. The apparatus of claim 7 wherein each shield is disposed in parallel relationship with each other as is each panel.

9. Apparatus of claim 8 wherein each of said panel bores has a rib spaced therefrom on either side thereof, said ribs extending from said panel in opposite directions and parallel with said panel bore, said ribs providing deflection resistance to said panels.

10. Apparatus of claim 8 wherein each of said shield bores is disposed adjacent juncture of an edge portion and central portion of a shield.

11. Apparatus of claim 2 including a housing for supporting said panels and shields therewithin, said panels and shields having a first end fixed to a first end of said housing, second ends of said shields and panels communicating with second end of said housing, and means for permitting relative movement between said second ends of said shields and panels and said second end of said housing.

12. Apparatus of claim 11 wherein said relative movement between said second ends of said shields and panels and said second end of said housing is a longitudinal movement responsive to thermally induced expansion and contraction thereof.

13. Apparatus of claim 12 wherein said pump provides a plurality of openings on either side thereof defined by opposed entrances to said passageways formed by said shields.

14. Apparatus of claim 13 further characterized by said shields being independently moveable adjacent said second end of said housing with respect to each other.

15. Apparatus of claim 14 further characterized by said housing including a pair of upstanding manifold plates provided at said first and second ends of said housing, a conduit adjacent each pair of said manifold plates for passage of said cryogenic fluid therethrough, said panels communicating between said conduits such that flow of said cryogenic fluid therebetween traces a parallel pattern.

16. Apparatus of claim 15 further characterized by means for permitting relative movement between said conduit adjacent said second end of said housing and said second end of said housing.

17. Apparatus of claim 16 further characterized by jumper tube means interconnecting adjacent shields such that flow of said refrigerant fluid therethrough traces a serial pattern.

18. Apparatus of claim 17 wherein said means for permitting said relative movement includes a heat insulative web having a slot disposed therein, said web secured to said manifold plates adjacent said second end of said housing, and other means disposed at said second end of said housing communicating with said web permitting movement therebetween in a direction defined by said slot in said web.

19. Apparatus of claim 18 further characterized by a plurality of holes provided in said manifold plates at said second end of said housing disposed vertically therein, sleeve means connected to said second ends of said shields for engaging said holes for longitudinal movement therethrough, said holes restraining movement of said sleeve means other than said longitudinal movement.

20. Apparatus of claim 19 wherein a plurality of shield guards interiorly said manifold plates and exteriorly said shields are supported by said manifold plates, and means for permitting relative movement between said shield guards and manifold plates at said second end of said housing.

* * * * *